US006393678B1

(12) United States Patent
Fildan et al.

(10) Patent No.: US 6,393,678 B1
(45) Date of Patent: May 28, 2002

(54) FLEXIBLE FASTENER FOR GARMENTS

(75) Inventors: Gerhard Fildan, Vienna; Karl Wanzenböck, Leobersdorf, both of (AT)

(73) Assignee: Fildan Accessories Corporation, Humble, TX (US)

( * ) Notice: Subject to any disclaimer, the term of this patent is extended or adjusted under 35 U.S.C. 154(b) by 0 days.

(21) Appl. No.: 09/827,367

(22) Filed: Apr. 5, 2001

(51) Int. Cl.[7] ..... A44B 17/00
(52) U.S. Cl. ..... 24/662; 24/693
(58) Field of Search ..... 24/406, 114.4, 24/104, 106–108, 585.1–586.11, 662, 630, 697.1, 693, 689, 114.6, DIG. 16, DIG. 40, DIG. 50

(56) References Cited

U.S. PATENT DOCUMENTS

| | | | | |
|---|---|---|---|---|
| 3,396,436 A | * | 8/1968 | Daddona, Jr. | 24/689 |
| 3,553,786 A | | 1/1971 | Carlile | |
| 3,685,105 A | | 8/1972 | Carlile et al. | |
| 5,758,589 A | | 6/1998 | Pommier | |
| 6,199,248 B1 | * | 3/2001 | Akashi et al. | 24/114.6 |

FOREIGN PATENT DOCUMENTS

| | | | |
|---|---|---|---|
| DE | 1 166 530 | | 2/1967 |
| DE | 39 19 766 A1 | | 12/1990 |
| EP | 0 248 970 | | 12/1987 |
| FR | 04 624 | | 7/1980 |
| GB | 1 059 052 | | 2/1967 |
| JP | 2000-175710 | * | 6/2000 |

* cited by examiner

*Primary Examiner*—James R. Brittain
(74) *Attorney, Agent, or Firm*—Herbert Dubno

(57) ABSTRACT

A flexible fastener for the backstrap of lingerie or the like garments and especially swimsuits can have soft polyurethane carrier tapes which can be transparent or translucent and have eyelets or press buttons fitted into and ultrasonically welded in holes of the tape. The holes are surrounded by rings engaged by the flanges of the eyelets and press buttons to prevent slipping of the tape around the eyelets or press buttons.

11 Claims, 12 Drawing Sheets

FIG. 19
FIG. 20
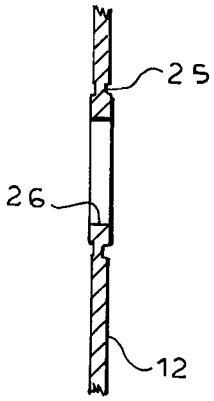
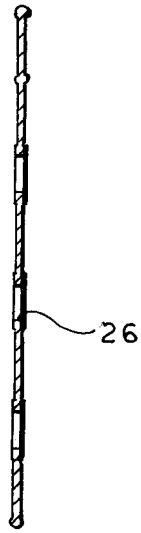
FIG. 22
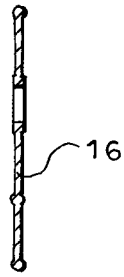

FLEXIBLE FASTENER FOR GARMENTS

FIELD OF THE INVENTION

The present invention relates to a flexible fastener for garments and especially bathing suits and lingerie, particularly for use as a back strap fastener. More particularly, the invention relates to a press button type fastener for such garments.

BACKGROUND OF THE INVENTION

Garment fasteners for securing the backstrap of a garment, for example, a brassiere, some other undergarments or articles of lingerie, a swimsuit or the like can have various configurations to facilitate connection of the backstrap and separation thereof and must, in addition, be capable of withstanding substantial tension thereon. It is advantageous, moreover, that the fastener be flexible for comfort. Esthetic considerations are also significant.

The most typical fasteners for this purpose are hook and eye fasteners in which usually a plurality of eyes are provided on one part of the backstrap and can be engaged by a lesser number of hooks on another part of the backstrap. The hooks are usually composed of metal. While this type of fastener is widely used, it has the disadvantage that the hooks can damage the garment or other garments in use and may not be comfortable for the wearer. In laundering the hooks likewise pose a problem.

Pushbutton fasteners have been developed in which a press button is releasably engageable in an eyelet and, while such fasteners have eliminated drawbacks of the conventional hook and eye type fastener and may even be used in a manner similar to that of the hook and eye fastener, the system may not be practical or desirable for all purposes. For example, in swimsuits and the like, a high degree of flexibility may be required and previous systems for mounting plastic or stud type fasteners may be inadequate.

Furthermore, there is increasing interest in see-through garments or garments with see-through portions which cannot accommodate conventional fasteners.

OBJECTS OF THE INVENTION

It is, therefore, the principal object of the invention to provide a garment fastener which is free from the drawbacks of earlier fasteners as described above.

Another object of this invention is to provide a garment fastener, particularly suitable for brassieres, lingerie and swimsuits and especially as a backstrap fastener thereof, which can be easily mounted and easily operated.

Another object of this invention is to provide an improved garment fastener having esthetic characteristics distinguishing it from earlier garment fasteners.

Still another object of the invention is to provide an improved method of making a garment fastener for swimsuits, brassieres, lingerie and the like.

SUMMARY OF THE INVENTION

We have found that it is possible to provide a garment fastener, especially for the backstrap of a swimsuit or other garment which has male and female fastener parts, each of which has a carrier tape which can be composed of flexible polyurethane and can be transparent or translucent and onto which the respective cooling members can be fitted and secured in place by engagement of male and female portions of each coupling member through holes formed in the carrier tape. In addition, the engaging elements of each coupling member can be ultrasonically welded together through the respective hole.

To prevent shifting of the injection-molded coupling members, each consisting of two elements joined together through the hole, the carrier tape may be formed with rings around the holes and over which the flanges of the elements can extend. Preferably these flanges have ridges engageable behind the rings and preferably in grooves around the rings.

The holding ring prevents the carrier tape from slipping out of the two elements or two parts of the stud.

From an esthetic point of view, the fastener is advantageous in that the carrier tape can be transparent or translucent, in keeping with the interest in see-through garments, or of a color which can be the same as or different from the colors of the studs which are applied to the carrier tape. Since the two elements forming a stud and applied to different sides of the tape can be molded to be of different colors or the same color, the number of color schemes provided by the studs and tapes is further enhanced.

On the male fastener part, the studs form press buttons which engage in the eyelets formed by the studs on the female fastener part.

According to the invention, therefore, a flexible fastener for a garment can comprise:

a female fastener member including a first flexible carrier tape composed of a synthetic resin and having at least one hole, a ring molded from the first flexible tape and surrounding the hole, and an eyelet fitting into the hole and composed of ring-shaped elements pressed one into another through the hole and having respective flanges on opposite sides of the first flexible carrier tape overlying the ring of the first flexible tape; and a male fastener member including a second flexible carrier tape composed of a synthetic resin and having at least one hole, a ring molded from the second flexible tape and surrounding the hole of the second flexible tape, and a press button fitting into the hole of the second flexible tape and composed of ring-shaped elements pressed one into another through the hole of the second flexible tape and having respective flanges on opposite sides of the second flexible tape overlying the ring of the second flexible tape.

Advantageously, the elements which, when pressed together through the hole form the eyelet stud or the press button stud, can be molded on a trunk which can be folded so that these elements straddle the tape and are pressed together through the holes.

When the elements are to be pressed into a soft plastic rather than a foil, the upper male part of the press button and the lower female part for the press button can each be provided with teeth spaced around the respective flange and adapted to bite into the soft plastic foil.

BRIEF DESCRIPTION OF THE DRAWING

The above and other objects, features, and advantages will become more readily apparent from the following description, reference being made to the accompanying drawing in which:

FIG. 19 is a cross sectional view taken along the line XIX—XIX of FIG. 18;

FIG. 20 is a cross sectional detailed view through one of the holes;

FIG. 22 is a cross sectional view taken along the line XXII—XXII of FIG. 21;

SPECIFIC DESCRIPTION

Figure 3:
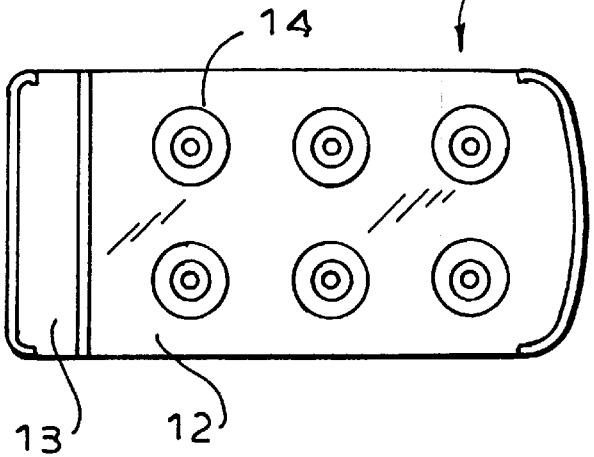
FIG. 3 is an elevational view of the female fastener for a swimsuit or brassiere.
Figure 4:
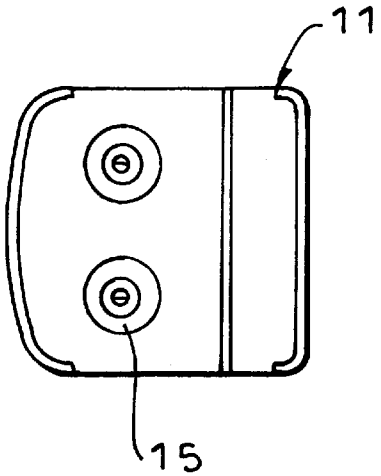
FIG. 4 is a plan view of the male fastener, seen from below.

From FIGS. 3 and 4 it will be apparent that the fastener according to the invention can comprise a female fastener member 10 and a male fastener member 11, adapted to be mounted on the separable parts of a swimsuit back or a brassiere back and to be connected together. The female fastener member includes a flexible carrier tape 12 which may be composed of a synthetic resin, especially transparent polyurethane which can be stitched or ultrasonically welded to the respective part of the backstrap by a flange 13. The carrier tape 12 is formed with three rows of eyelets 14, each row consisting of two eyelets positioned to be engaged by the press buttons 15 carried by a similar transparent carrier tape 16 of the male fastener member 11.

Figure 1:
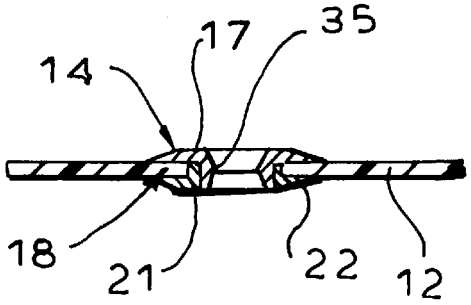
FIG. 1 is a cross sectional view illustrating an eyelet forming one coupling element of a fastener according to the invention.
Figure 2:
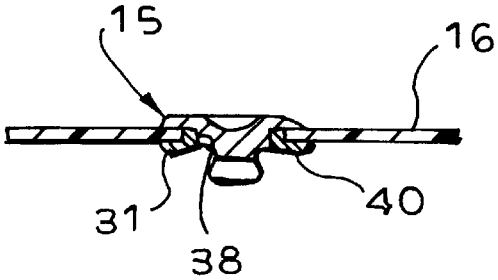
FIG. 2 is a cross sectional view of the press button.

As will be apparent from FIG. 1, each eyelet 14 can be composed of a ring-shaped male member 17 and a female member 18 which are pressed together through a hole in the tape 12 and are ultrasonically welded together.

Figure 14:
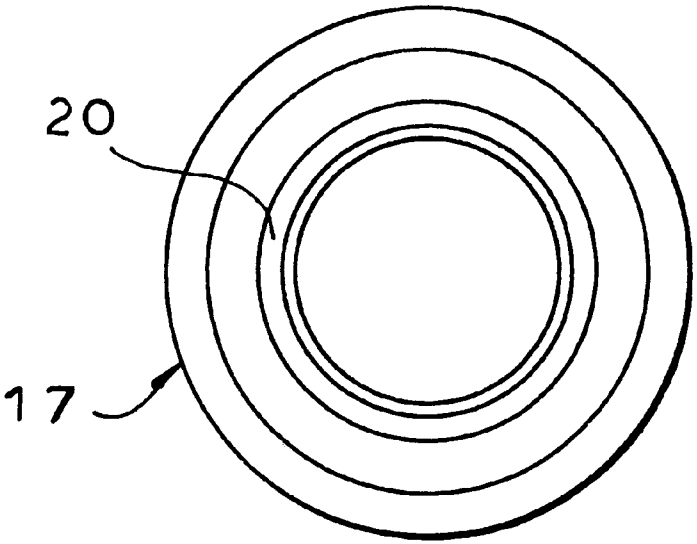
FIG. 14 is a view in the direction XIV—XIV of FIG. 13.
Figure 13:
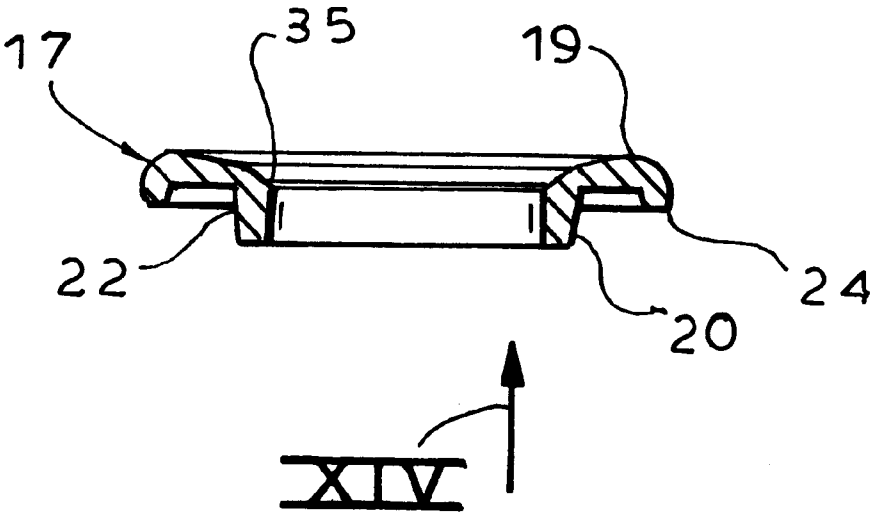
FIG. 13 is a cross sectional view through the male part of an eyelet in accordance with the invention.

The male ring-shaped element 17 has been shown in greater detail in FIGS. 13 and 14 and comprises a flange 19 which is formed with a cylindrical stud 20 fitting into the stud 21 of the female member 18 which has a corresponding flange 22 (see FIG. 1).

The outer surface 23 of the stud 20 and the inner surface of the stud 21 are tapered as shown in FIG. 13 so that the two parts can be pressed together with a snug fit.

Figure 21:
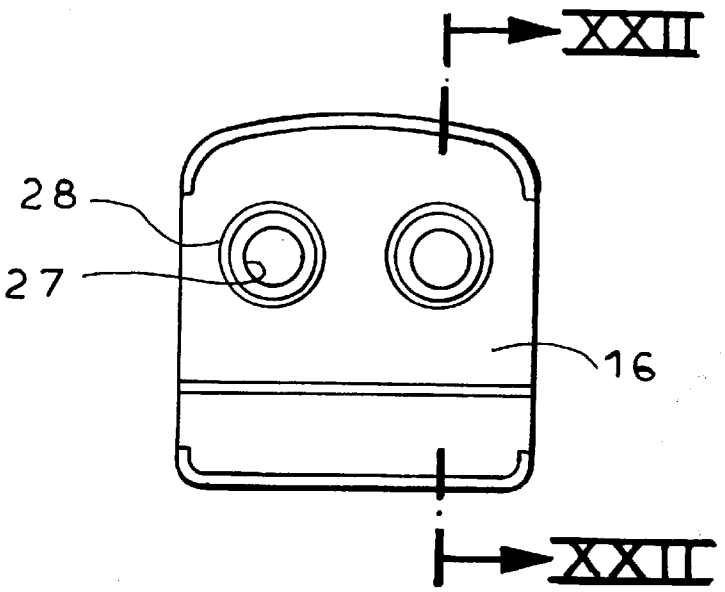
FIG. 21 is a view similar to FIG. 18 but showing the tape of the male fastener.
Figure 18:
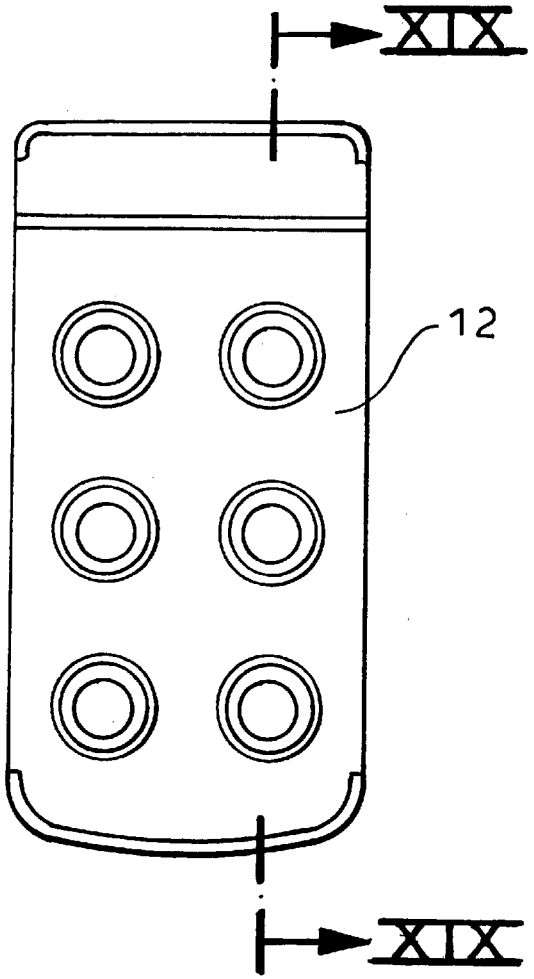
FIG. 18 is an elevational view of the tape of the female member prior to application of the eyelets.

The flange 19, like the flange 22, can be formed with a ridge 24 engageable in a respective groove 25 surrounding the hole 26 in the carrier tape 12 (see FIGS. 18 through 20). Such grooves 25 are provided on both sides of the tape 12 around the hole. Similarly, holes 27 and annular grooves 28 are provided on the tape 16 of the male fastener member (see FIGS. 21 and 22).

Figure 12:
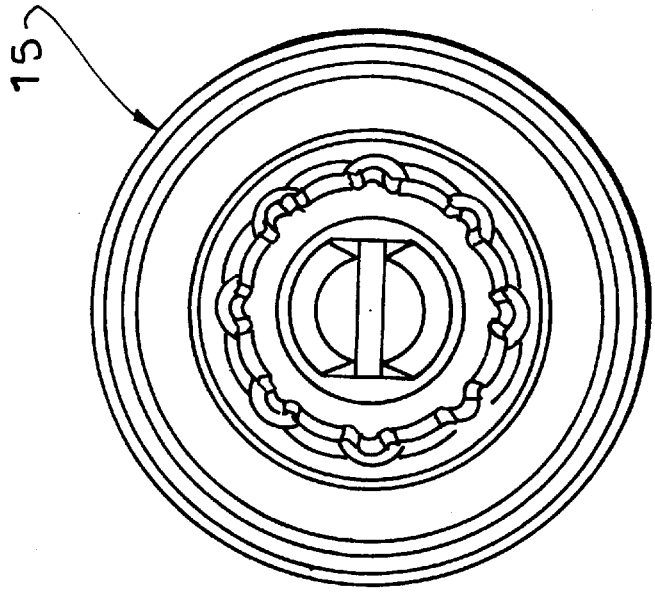
FIG. 12 is an elevational view taken in the direction of arrow XII thereof.
Figure 11:
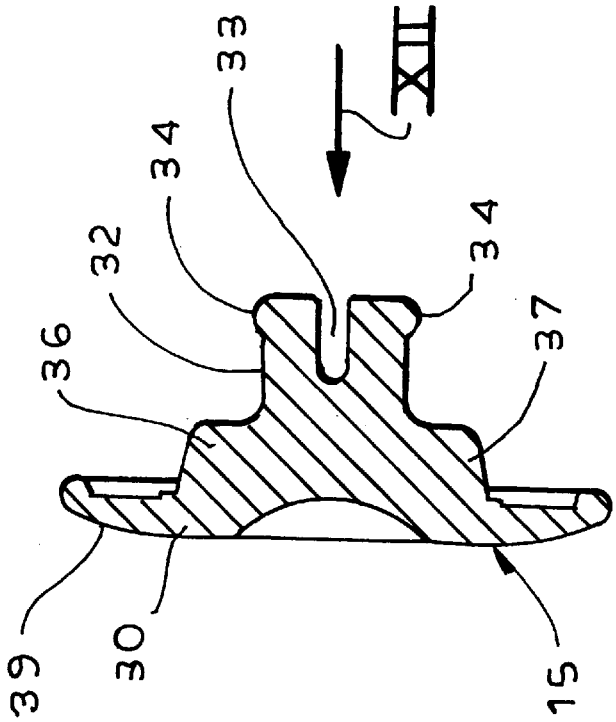
FIG. 11 is a cross sectional view through one element of the male coupling member.

As will be apparent from FIGS. 11 and 12, the press button 15 also can comprise ring-shaped elements 30 and 31, the ring-shaped element 30 having a projection 32 which is split at 33 and is formed with bulges 34 engageable in and behind a construction 35 formed in the eyelet in which the press button is fitted.

A large diameter boss 36 of element 30 has a tapered surface 38 of the element 31 so that the male and female elements 31 can be pressed together so that their flanges 39 and 40, respectively, have their ridges 41 and 42 engaged in the grooves 28 of the tape 16.

Figure 23:
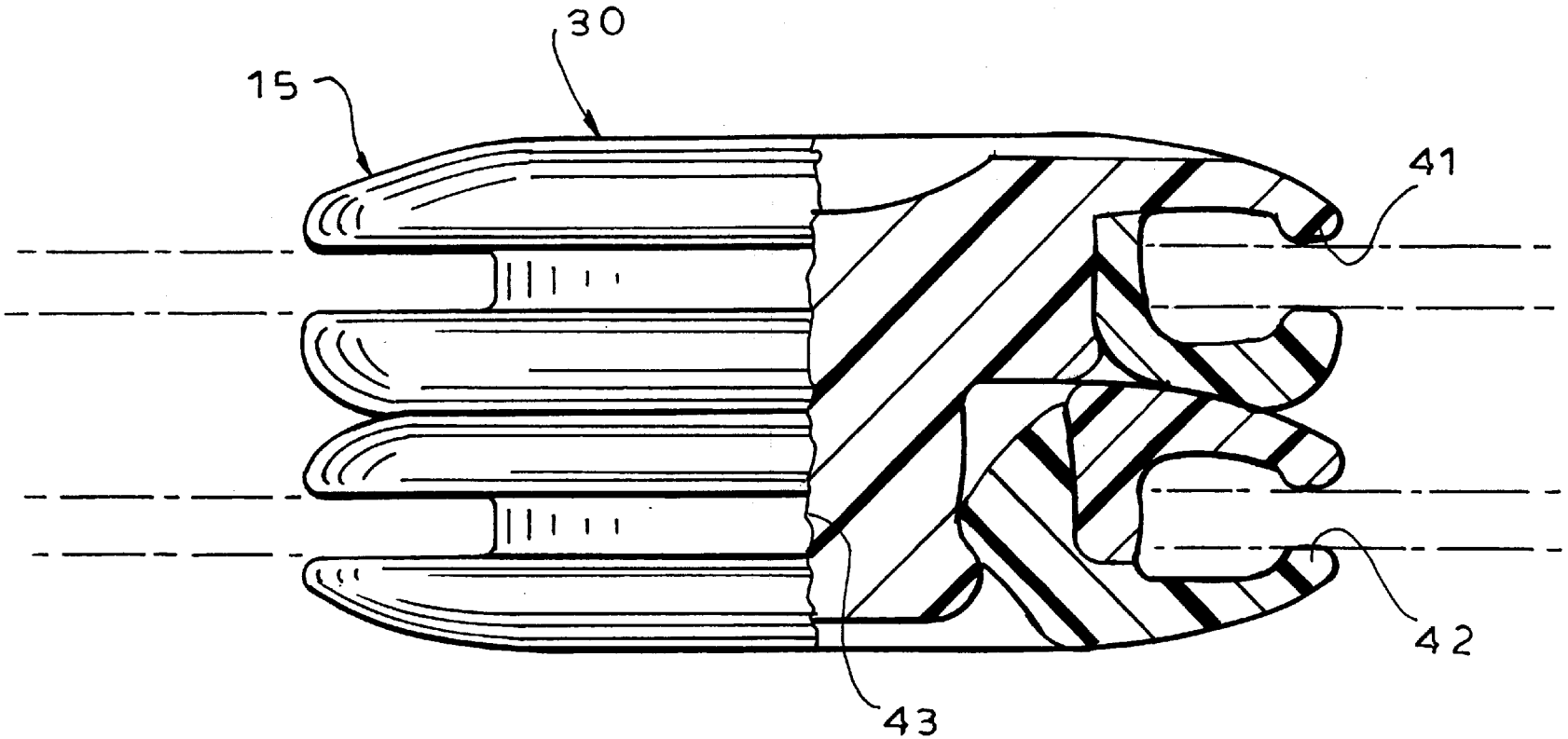
FIG. 23 is an elevational view showing the interconnected coupling member partly in section and without the carrying tapes.
Figure 25:
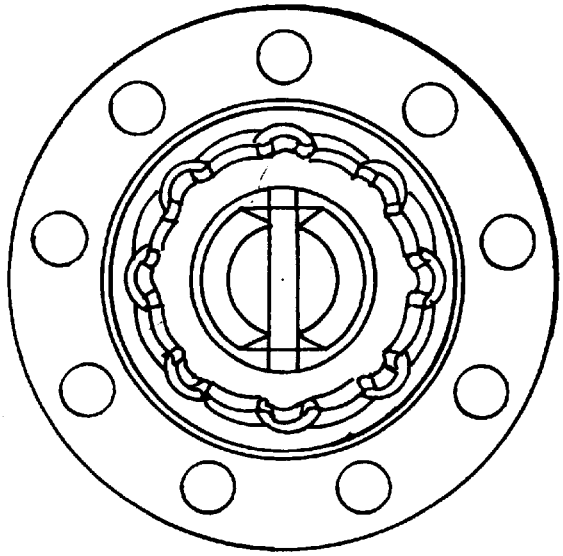
FIG. 25 is a bottom view thereof.
Figure 24:
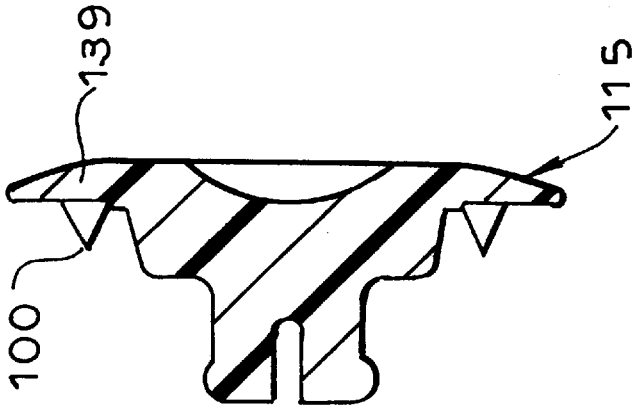
FIG. 24 is a cross sectional view of an upper male part for a press button which is intended to be used for attachment to a soft plastic foil.
Figure 27:
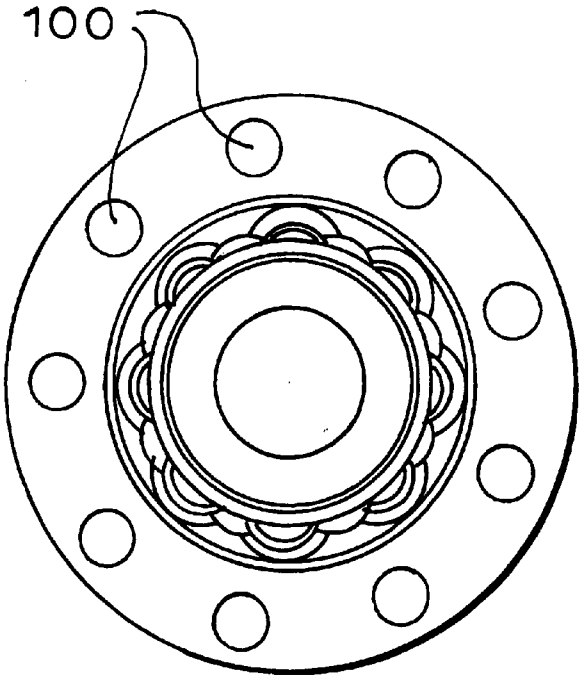
FIG. 27 is a plan view of this female part of the press button.
Figure 26:
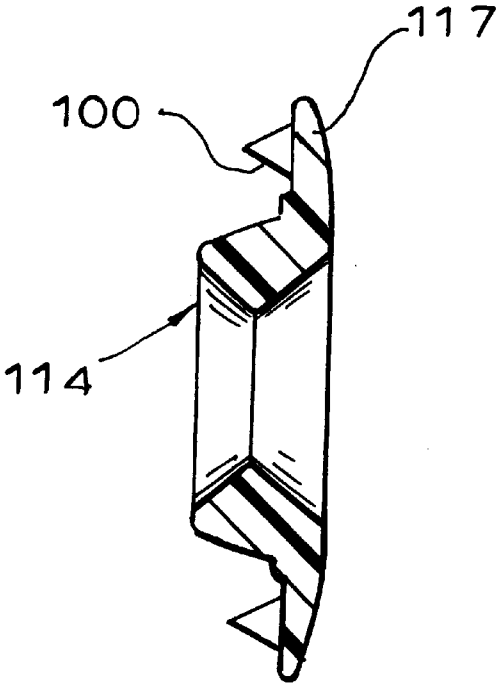
FIG. 26 is a cross sectional view of the lower part of the female member of the press button.

In addition, the engaging surfaces of the element 17 and 31 of the eyelet 14 and the press button 15 (FIG. 23) may be complementarily contoured at 43 so that the overall height of the engaged members is as small as possible.

The ring-shaped elements of each fastener member may be of the same or different colors and can be composed of polyoxymethylene.

Figures 5, 6, 7:
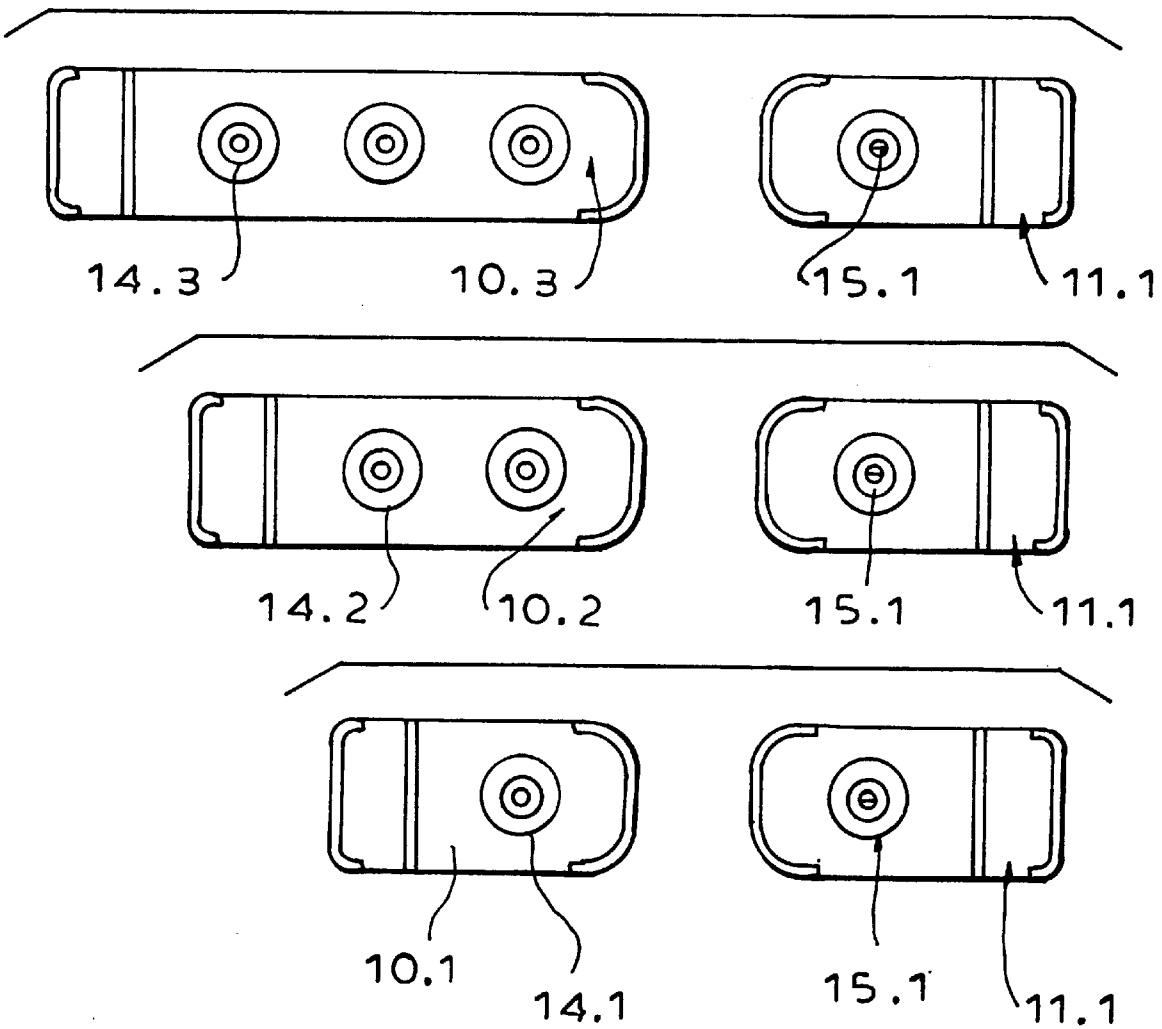
FIGS. 5, 6 and 7 are plan views of other fastener arrangements in which a single press button is used.

As can be seen from FIGS. 5 to 7, the female fastener members 10.1, 10.2 and 10.3 may have 1, 2 or 3 eyelets 14.1, 14.2 or 14.3 which can be selectively engaged by the single eyelet 15 of the male fastener member 11.1 to allow adjustment of the strap.

Figures 8, 9, 10:
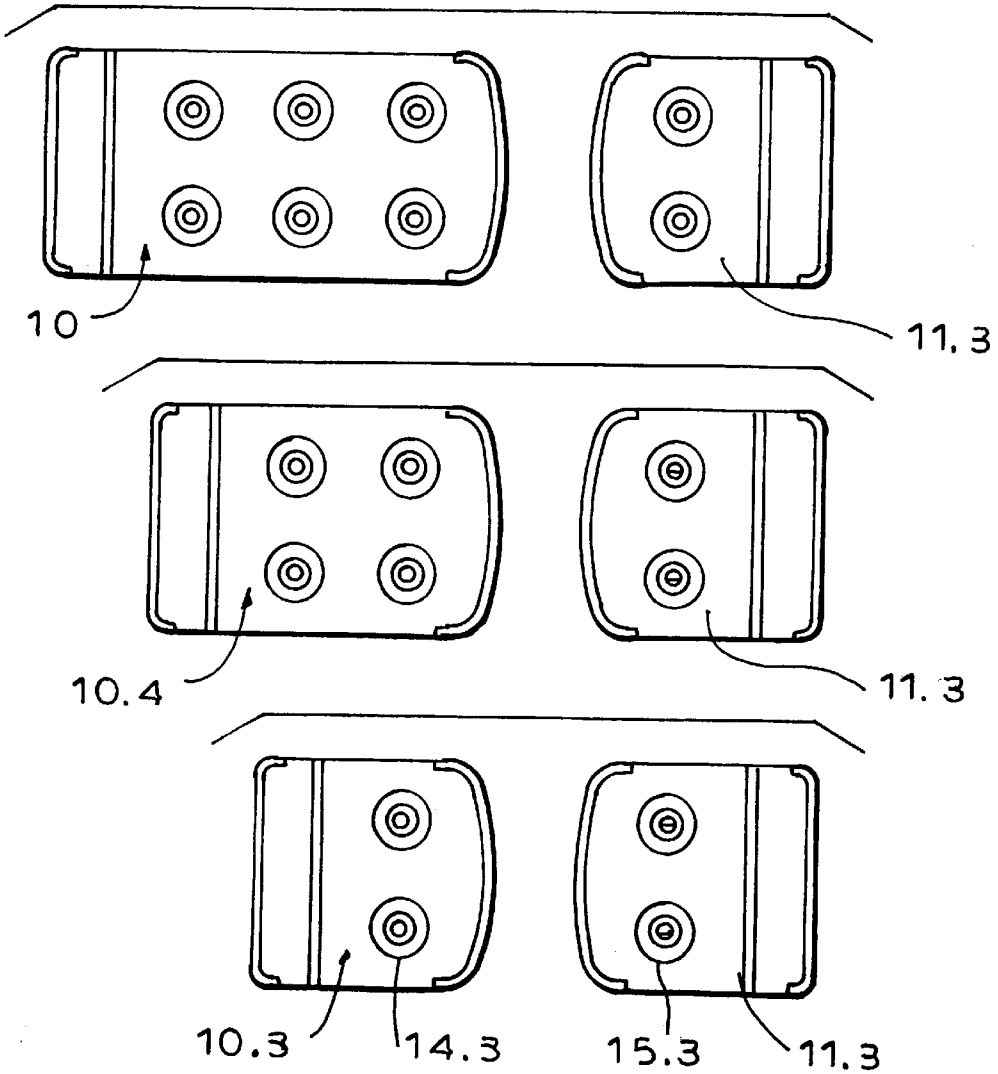
FIGS. 8, 9 and 10 are views similar to FIGS. 5 to 7 in which rows of coupling members are provided.
Figure 16:
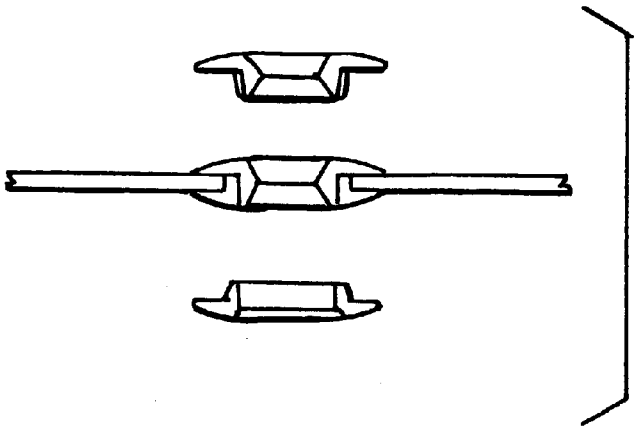
FIG. 16 is an assembly diagram for the eyelet.
Figure 15:
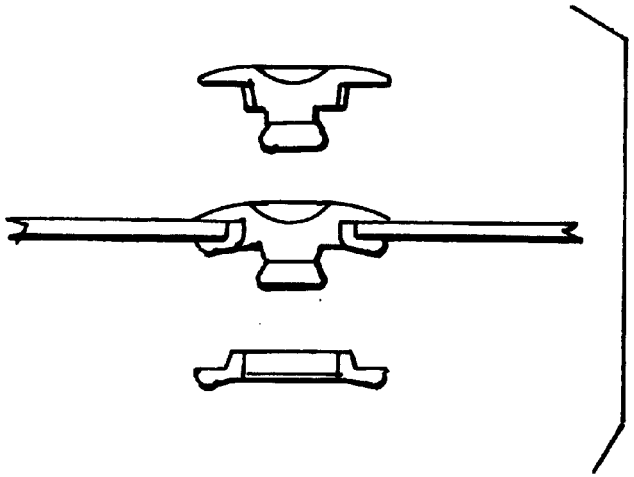
FIG. 15 is a diagram showing assemblies of the press button.
Figure 17:
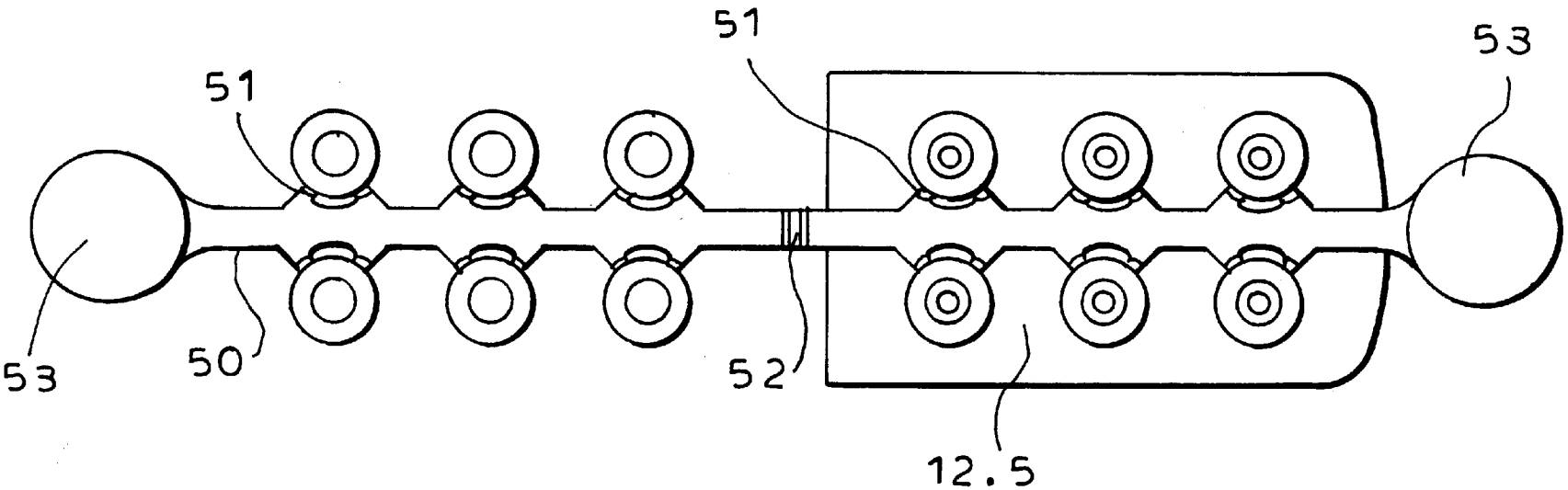
FIG. 17 is a plan view of an injection molded unit facilitating mounting of the eyelets.

Alternatively, the number of rows of eyelets 14.3 of the female member 10.3 or 10.4 may vary as can be seen by a comparison of FIGS. 8 to 10, using a single pair of eyelets 15.3 on the tape of the male fastener member 11.3. FIGS. 15 to 17 show in principle the way in which the fasteners can be formed. The elements of the coupling members to be disposed on opposite sides of a tape 12.5, for example, are injection molded on a common trunk 50 with break away locations or thin points 51. The trunk 50 is then bent at 52 to lie on opposite sides of the tape 12.5 and the male and female elements of the press button (FIG. 15) or the eyelet (FIG. 16) can be braced together and ultrasonically welded together in the preformed holes of the tape 12.5. Using the handles 53, the trunk 50 is then torn away at the weakened points 51, leaving the eyelets or press buttons in place.

As can be seen from FIGS. 24, 25, 26 and 27, the flanges 139 of the male member 115 and 117 of the female member 114 can be provided with teeth 100 adapted to bite into a soft plastic film when the latter is used as a carrier.

We claim:

1. A flexible fastener for garments comprising:

a female fastener member including a first flexible carrier tape composed of a synthetic resin and having at least one hole, a ring molded from said first flexible tape and surrounding said hole, and an eyelet fitting into said hole and composed of ring-shaped elements pressed one into another through said hole and having respective flanges on opposite sides of the first flexible carrier tape overlying said ring of said first flexible tape; and a male fastener member including a second flexible carrier tape composed of a synthetic resin and having at least one hole, a ring molded from said second flexible tape and surrounding said hole of said second flexible tape, and a press button fitting into said hole of said second flexible tape and composed of ring-shaped elements pressed one into another through said hole of said second flexible tape and having respective flanges on opposite sides of said second flexible tape overlying said ring of said second flexible tape.

2. The flexible fastener defined in claim 1 wherein each of said flanges has a ridge engaging behind the respective ring.

3. The flexible fastener defined in claim 2 wherein each of said rings is surrounded by an annular groove receiving the respective ridge.

4. The flexible fastener defined in claim 1 wherein said carrier tapes are composed of soft polyurethane.

5. The flexible fastener defined in claim 1 wherein at least one of said carrier tapes is transparent or translucent.

6. The flexible fastener defined in claim 1 wherein said one of the elements of at least one of said members is of a different color from the other element of the respective member.

7. The flexible fastener defined in claim 1 wherein at least one of the elements of at least one of said members is of a different color from the flexible carrier tape thereof.

8. The flexible fastener defined in claim 1 wherein said first flexible carrier tape has a plurality of said holes, respective rings surrounding said holes and respective eyelets fitted into said holes.

9. The flexible fastener defined in claim 8 wherein said first flexible carrier tape is formed with a row of pairs of said holes, rings surrounding said holes and said eyelets of said female fastener member and said male fastener member has a pair of said press buttons each adapted to fit into an eyelet of a respective row of said female fastener.

10. The flexible fastener defined in claim 1 wherein the elements of each member are ultrasonically welded together through the respective hole.

11. The flexible fastener defined in claim 1 wherein one of the elements of said male fastener member abuts one of the elements of said female fastener when said press button is engaged in said eyelet, the abutting elements having complementary contours with mutually engaging convex and concave configurations respectively.

* * * * *